US008912989B2

(12) United States Patent
Chung et al.

(10) Patent No.: US 8,912,989 B2
(45) Date of Patent: Dec. 16, 2014

(54) PIXEL AND ORGANIC LIGHT EMITTING DISPLAY DEVICE USING THE SAME

(75) Inventors: Bo-Yong Chung, Yongin (KR); Yong-Sung Park, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 561 days.

(21) Appl. No.: 12/916,290

(22) Filed: Oct. 29, 2010

(65) Prior Publication Data

US 2011/0227885 A1 Sep. 22, 2011

(30) Foreign Application Priority Data

Mar. 16, 2010 (KR) ..... 10-2010-0023242
Jul. 27, 2010 (KR) ..... 10-2010-0072433

(51) Int. Cl.
*G09G 3/30* (2006.01)
*G09G 3/32* (2006.01)

(52) U.S. Cl.
CPC ..... *G09G 3/3241* (2013.01); *G09G 2310/0262* (2013.01); *G09G 2300/043* (2013.01); *G09G 2300/0852* (2013.01); *G09G 2320/043* (2013.01)
USPC ..... 345/77

(58) Field of Classification Search
USPC ..... 345/76, 77, 82, 83; 315/169.3
See application file for complete search history.

(56) References Cited

U.S. PATENT DOCUMENTS

| | | | | |
|---|---|---|---|---|
| 7,646,366 | B2 * | 1/2010 | Ha et al. | 345/82 |
| 2006/0055336 | A1 * | 3/2006 | Jeong | 315/169.3 |
| 2006/0066532 | A1 * | 3/2006 | Jeong | 345/76 |
| 2006/0238461 | A1 * | 10/2006 | Goh et al. | 345/76 |
| 2007/0040770 | A1 * | 2/2007 | Kim | 345/76 |
| 2009/0027310 | A1 * | 1/2009 | Kim | 345/76 |
| 2011/0164071 | A1 * | 7/2011 | Chung et al. | 345/690 |
| 2011/0193850 | A1 * | 8/2011 | Chung et al. | 345/212 |
| 2011/0199357 | A1 * | 8/2011 | Chung et al. | 345/211 |

FOREIGN PATENT DOCUMENTS

| | | | | |
|---|---|---|---|---|
| EP | 1764772 | A2 * | 3/2007 | G09G 3/32 |
| KR | 10-2005-0106834 | | 11/2005 | |
| KR | 10-2007-0065694 | | 6/2007 | |

* cited by examiner

*Primary Examiner* — Adam J Snyder
*Assistant Examiner* — Roy Rabindranath
(74) *Attorney, Agent, or Firm* — Christie, Parker & Hale, LLP

(57) ABSTRACT

An organic light emitting display device includes: a scan driver for supplying partially overlapping scan signals having at least 2H width and for supplying emission control signals; a data driver; and pixels, each including: an OLED having a cathode coupled to second power; a first transistor having a first electrode coupled to first power; a second transistor between a gate electrode and a second electrode of the first transistor and turned on when the scan signal is supplied to a current scan line; a third transistor between the data line and a second node and turned on when the scan signal is supplied to a subsequent scan line; a first capacitor coupled between the first transistor gate electrode and the second node; and a fourth transistor turned on when the scan signal is supplied to a previous scan line to supply a first voltage to the first transistor gate electrode.

24 Claims, 8 Drawing Sheets

PIXEL AND ORGANIC LIGHT EMITTING DISPLAY DEVICE USING THE SAME

CROSS-REFERENCE TO RELATED APPLICATION

This application claims priority to and the benefit of Korean Patent Application No. 10-2010-0023242, filed on Mar. 16, 2010 and Korean Patent Application No. 10-2010-0072433, filed on Jul. 27, 2010, in the Korean Intellectual Property Office, the entire content of both of which are incorporated herein by reference.

BACKGROUND

1. Field

Embodiments of the present invention relate to a pixel and an organic light emitting display device including the same.

2. Description of the Related Art

In recent years, various flat panel displays having reduced weight and volume in comparison to cathode ray tubes have been developed. Examples of the flat panel displays include liquid crystal displays, field emission displays, plasma display panels, organic light emitting display devices, etc.

An organic light emitting display device, which is one of the flat panel displays, displays images by using organic light emitting diodes that generate light by recombining electrons and holes, has rapid response speed, and is driven with low power consumption.

The organic light emitting display device includes a plurality of pixels that are arranged in a matrix pattern at crossing regions of a plurality of data lines, scan lines, and power supply lines. Each of the pixels generally includes an organic light emitting diode, two or more transistors including a driving transistor, and one or more capacitors.

Such an organic light emitting display device typically has low power consumption, but the amount of current that flows on the organic light emitting diode may vary depending on a threshold voltage variation of the driving transistor included in each of the pixels, thereby causing display nonuniformity. That is, characteristics of the driving transistor vary depending on variables of a manufacturing process of the driving transistor included in each of the pixels. Actually, it is very difficult or impossible to manufacture all transistors of the organic light emitting display device to have the same characteristic in a process step using existing technologies. As a result, threshold voltage variations of the driving transistors are generated.

In order to solve the problem, a method of adding a compensation circuit constituted by a plurality of transistors and capacitors in each of the pixels has been proposed. The compensation circuit included in each of the pixels charges voltage corresponding to threshold voltage of the driving transistor to thereby compensate for the threshold variation of the driving transistor.

Recently, a driving method using a frequency of 120 Hz or more has been used in order to remove a motion blur phenomenon. However, in the case of high-speed driving at 120 Hz or more, a charging duration of the threshold voltage of the driving transistor is shortened, such that compensation of the threshold voltage of the driving transistor may become very difficult or impossible. Further, in the high-speed driving at 120 Hz or more, an initialization period when a gate electrode of the driving transistor is initialized to a predetermined voltage cannot be sufficiently ensured before the threshold voltage is compensated, as a result, stable compensation is very difficult or impossible.

SUMMARY

Accordingly, an exemplary embodiment of the present invention provides a pixel and an organic light emitting display device using the same that can sufficiently ensure a threshold voltage compensation period and an initialization period.

An exemplary embodiment of the present invention provides an organic light emitting display device. The organic light emitting display device includes: a scan driver for sequentially supplying scan signals having a width of at least 2H to scan lines and for supplying emission control signals to emission control lines arranged in parallel to the scan lines, the scan signals partially overlapping with each other; a data driver for supplying data signals to data lines; and pixels located at crossing regions of the scan lines and the data lines, wherein each of the pixels includes: an organic light emitting diode having a cathode electrode electrically coupled to a second power source; a first transistor having a first electrode coupled to a first power source, and located between the first power source and the organic light emitting diode, the first transistor being for controlling an amount of current supplied from the first power source to the organic light emitting diode; a second transistor between a gate electrode and a second electrode of the first transistor and configured to be turned on when a corresponding one of the scan signals is supplied to a current scan line of the scan lines, the gate electrode of the first transistor being electrically coupled to a first node; a third transistor between a corresponding one of the data lines and a second node and configured to be turned on when a corresponding one of the scan signals is supplied to a subsequent scan line of the scan lines; a first capacitor electrically coupled between the gate electrode of the first transistor and the second node; and a fourth transistor configured to be turned on when a corresponding one of the scan signals is supplied to a previous scan line of the scan lines to supply a first voltage to the gate electrode of the first transistor.

The organic light emitting display device may further include: a fifth transistor for supplying a second voltage to the second node when the corresponding one of the scan signals is supplied to the current scan line; and a sixth transistor between the second electrode of the first transistor and the organic light emitting diode and configured to be turned off when a corresponding emission control signal of the emission control signals is supplied to a current emission control line of the emission control lines.

The fifth transistor may be between the second node and the first power source. The fifth transistor may be between the second node and a reference power source for supplying the second voltage, and the second voltage may be equal to or greater than a voltage of the data signals.

The fourth transistor may be electrically coupled to the gate electrode of the first transistor and an anode electrode of the organic light emitting diode. The fourth transistor may be between the gate electrode of the first transistor and the second power source. The fourth transistor may be between the gate electrode of the first transistor and an initialization power source for supplying the first voltage, and the first voltage may be lower than a voltage of the data signals.

The current scan line may be an i-th scan line of the scan lines, the previous scan line may be an i−2-th scan line of the scan lines, and the subsequent scan line may be an i+3-th scan line of the scan lines, wherein i is a natural number. The current emission control line may be an i-th emission control line of the emission control lines.

The scan driver may be configured to supply the scan signals during a period of 3H and the scan signal supplied to the i-th scan line from among the scan signals may be overlapped with the scan signal supplied to the i−1-th scan line from among the scan signals during a period of 2H. The scan driver may be configured to sequentially supply the emission control signals to the emission control lines, and the emission control signal supplied to the i-th control line from among the emission control signals may be overlapped with the scan signals supplied to the i−2-th scan line through the i+3-th scan line.

The organic light emitting display device may further include a second capacitor electrically coupled between the second node and the first power source. The organic light emitting display device may further include a second capacitor electrically coupled between the gate electrode of the first transistor and the first power source. The scan driver may be configured to supply the emission control signals to the emission control lines concurrently while the scan signals are sequentially supplied to all the scan lines and may not supply the emission control signals to the emission control lines after the scan signals cease to be supplied. The data driver may be configured to supply the data signals to the data lines every period of 1H.

Another exemplary embodiment according to the present invention provides a pixel including: an organic light emitting diode having a cathode electrode electrically coupled to a second power source; a first transistor having a first electrode coupled to a first power source, and configured to control an amount of current from the first power source to the organic light emitting diode; a second transistor between a gate electrode and a second electrode of the first transistor and configured to be turned on when a scan signal is supplied to an i-th scan line, wherein the gate electrode of the first transistor is electrically coupled to a first node and i is a natural number; a third transistor between a data line and a second node and configured to be turned on when the scan signal is supplied to an i+3-th scan line; a first capacitor electrically coupled between the gate electrode of the first transistor and the second node; a fourth transistor for supplying a second voltage to the second node when the scan signal is supplied to the i-th scan line; and a fifth transistor configured to be turned on when the scan signal is supplied to an i−2-th scan line to supply a first voltage to the gate electrode of the first transistor.

The pixel may further include a second capacitor electrically coupled between the second node and the first power source. The pixel may further include: a second capacitor electrically coupled between the gate electrode of the first transistor and the first power source. The pixel may further include: a sixth transistor between the second electrode of the first transistor and the organic light emitting diode and configured to be turned off when an emission control signal is supplied to an i-th emission control line.

The fourth transistor may be between the second node and the first power. The fourth transistor may be between the second node and a reference power source for supplying the second voltage, and the second voltage may be equal to or greater than a voltage of the data signal.

The fifth transistor may be electrically coupled to the gate electrode of the first transistor and an anode electrode of the organic light emitting diode. The fifth transistor may be between the gate electrode of the first transistor and the second power source. The fifth transistor may be between the gate electrode of the first transistor and an initialization power source for supplying the first voltage, and the first voltage may be lower than a voltage of the data signal.

A turn-on period of the first transistor may be partially overlapped with a turn-on period of the second transistor.

By using a pixel and an organic light emitting display device including the pixel according to exemplary embodiments of the present invention, it is possible to set a threshold voltage compensation period and an initialization period as a period of 2H or more; as a result, it is possible to apply them to high-speed driving.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
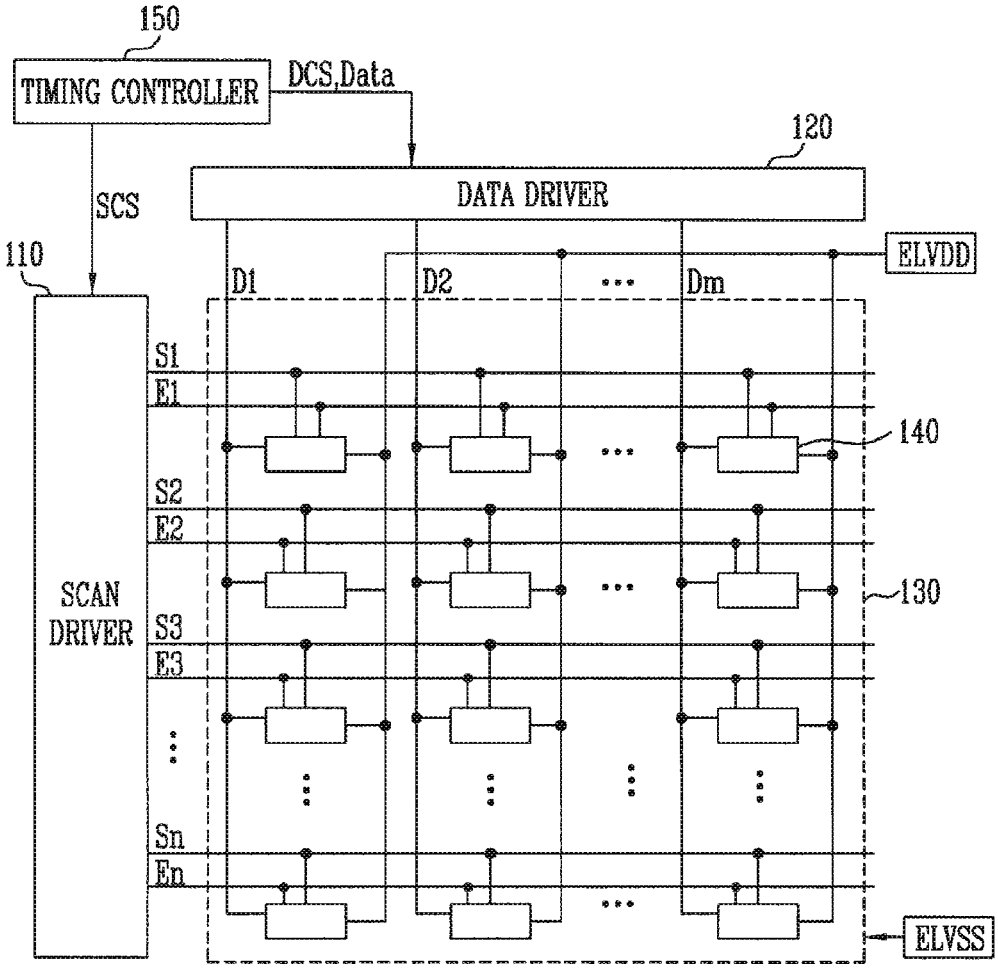
FIG. 1 is a diagram illustrating an organic light emitting display device according to an exemplary embodiment of the present invention.

Hereinafter, certain exemplary embodiments according to the present invention will be described with reference to the accompanying drawings. Here, when a first element is described as being coupled to a second element, the first element may be directly coupled to the second element or may be indirectly coupled to the second element via a third element. Further, some of the elements that are not essential to a complete understanding of the invention are omitted for clarity. Also, like reference numerals refer to like elements throughout.

Hereinafter, exemplary embodiments of the present invention will be described in detail with reference to FIGS. 1 to 9.

FIG. 1 is a diagram illustrating an organic light emitting display device according to an exemplary embodiment of the present invention.

Referring to FIG. 1, the organic light emitting display device according to the exemplary embodiment of the present invention includes: a display unit 130 including a plurality of pixels 140 that are positioned at crossing regions of scan lines S1 to Sn, emission control lines E1 to En, and data lines D1 to Dm; a scan driver 110 for driving the scan lines S1 to Sn and the emission control lines E1 to En; a data driver 120 for driving the data lines D1 to Dm; and a timing controller 150 for controlling the scan driver 110 and the data driver 120.

The scan driver 110 receives a scan driving control signal SCS from the timing controller 150. The scan driver 110 receiving the scan driving control signal SCS generates a scan signal and sequentially supplies the generated scan signal to the scan lines S1 to Sn.

Herein, the scan driver 110 supplies a scan signal having a width which is equal to or greater than 2H (herein, "H" represents a horizontal period) while scan signals applied to (or transmitted to) the scan lines S1 to Sn are overlapped with scan signals applied to (or transmitted to) previous scan lines during a partial period. Thereafter, for better comprehension and ease of description, it is assumed that the scan signal has a width of 3H and a scan signal which is supplied to an i (i is a natural number)-th scan line is overlapped with a scan signal which is supplied to an i−1-th scan line during the 2H period.

The scan driver 110 which receives the scan driving control signal SCS generates an emission control signal and sequentially supplies the generated emission control signal to the emission control lines E1 to En. Herein, an emission control signal which is supplied to an i-th emission control line Ei is supplied to be overlapped with scan signals which are supplied to an i−2-th scan line to an i+3-th scan line. In exemplary embodiments, the scan signal is set to a voltage (i.e., low voltage) at which transistors included in the pixels 140 are turned on and the emission control signal is set to a voltage (i.e., high voltage) at which the transistors included in the pixels 140 are turned off.

The data driver 120 receives the data driving control signal DCS from the timing controller 150. The data driver 120 receiving the data driving control signal DCS supplies the data signal to the data lines D1 to Dm in synchronization to (or in accordance with) the scan signal.

The timing controller 150 generates the data driving control signal DCS and the scan driving control signal SCS in accordance with synchronization signals supplied from the outside. The data driving control signal DCS generated by the timing controller 150 is supplied to the data driver 120 and the scan driving control signal SCS is supplied to the scan drive 110. In addition, the timing controller 150 supplies data Data supplied from the outside to the data driver 120.

The display unit 130 receives a first power ELVDD and a second power ELVSS from the outside, and supplies the first power ELVDD and the second power ELVSS to each of the pixels 140. Each of the pixels 140 which receives the first power ELVDD and the second power ELVSS generates light corresponding to the data signal. Herein, the first power ELVDD is set to voltage which is higher than the second power ELVSS to supply a current (e.g., a predetermined current) to the organic light emitting diode.

In FIG. 1, each of the pixels 140 is shown as being coupled to only one scan line, but the pixels 140 of the described embodiment are actually coupled to three scan lines. For example, a pixel 140 which is positioned on an i-th horizontal line is coupled with an i−2-th scan line Si−2, an i-th scan line Si, and an i+3-th scan line Si+3.

Figure 2:
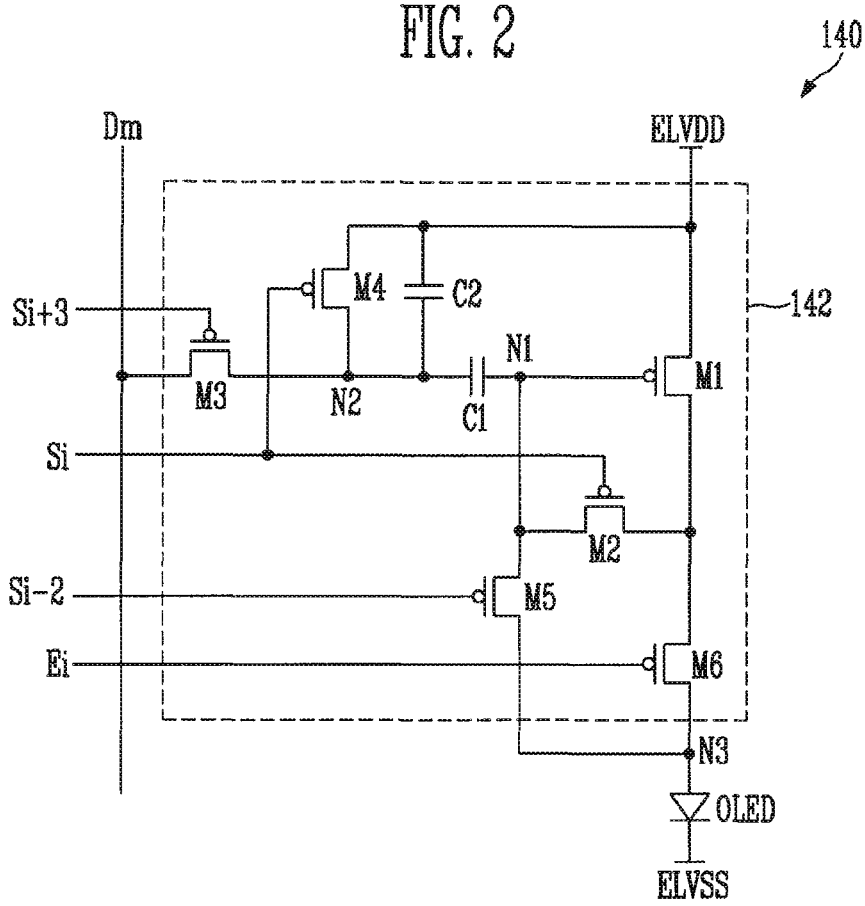
FIG. 2 is a circuit diagram illustrating a first exemplary embodiment of one of the pixels shown in FIG. 1.

FIG. 2 is a circuit diagram showing a pixel according to a first exemplary embodiment of the present invention. In FIG. 2, for better comprehension and ease of description, a pixel which is positioned on the i-th horizontal line and connected with an m-th data line Dm will be shown.

Referring to FIG. 2, the pixel 140 according to the first exemplary embodiment of the present invention includes an organic light emitting diode OLED and a pixel circuit 142 for controlling the amount of current supplied to the organic light emitting diode OLED.

An anode electrode of the organic light emitting diode OLED is electrically coupled to the pixel circuit 142 and a cathode electrode of the organic light emitting diode OLED is electrically coupled to the second power source ELVSS for supplying a second power. The organic light emitting diode OLED generates light having a luminance (e.g., a predetermined luminance) corresponding to the amount of current supplied from the pixel circuit 142.

The pixel circuit 142 initializes a gate electrode of a first transistor M1 (i.e., driving transistor) during a period when a scan signal is supplied to an i−2-th scan line, and charges voltage corresponding to a threshold voltage of the first transistor M1 (i.e., driving transistor) during a period when a scan signal is supplied to an i-th scan line Si. In addition, the pixel circuit 142 charges a voltage corresponding to the data signal during a period when a scan signal is supplied to an i+3-th scan line. Further, the pixel circuit 142 supplies current corresponding to a voltage which is charged after an emission control signal is supplied to an i-th emission control line Ei to the organic light emitting diode OLED. For this, the pixel circuit 142 includes first to sixth transistors M1 to M6, a first capacitor C1, and a second capacitor C2.

A gate electrode of the first transistor M1 is electrically coupled to a first node N1 and a first electrode of the first transistor M1 is electrically coupled to the first power source ELVDD. In addition, a second electrode of the first transistor M1 is electrically coupled to a first electrode of the sixth transistor M6. The first transistor M1 controls the amount of current which is supplied from the first power EVLDD to the second power ELVSS through the organic light emitting diode OLED in accordance with the voltage applied to the first node N1.

A gate electrode of the second transistor M2 is electrically coupled to the i-th scan line Si and a first electrode of the second transistor M2 is electrically coupled to a second electrode of the first transistor M1. In addition, a second electrode of the second transistor M2 is electrically coupled to the gate electrode of the first transistor M1 at the first node N1. The second transistor M2 is turned on when the scan signal is supplied to the scan line Sn to electrically couple the gate electrode and the second electrode of the first transistor M1 to each other. In this case, the first transistor M1 is diode-connected (or diode-coupled).

A gate electrode the third transistor M3 is electrically coupled to the i+3-th scan line Si+3 and a first electrode of the third transistor M3 is electrically coupled to the data line Dm. In addition, a second electrode of the third transistor M3 is electrically coupled to a second node N2. The third transistor M3 is turned on when the scan signal is supplied to the i+3-th scan line Si+3 to electrically couple the data line Dm and the second node N2 to each other.

A gate electrode of the fourth transistor M4 (which may be referred to as the "fifth transistor" in some of the claims) is electrically coupled to the i-th scan line Si and a first electrode of the fourth transistor M4 is electrically coupled to the first power source ELVDD. In addition, a second electrode of the fourth transistor M4 is electrically coupled to the second node N2. The fourth transistor M4 is turned on when the scan signal is supplied to the i-th scan line Si to supply the voltage of the first power source ELVDD to the second electrode N2.

A gate electrode of the fifth transistor M5 (which may be referred to as the "fourth transistor" in some of the claims) is electrically coupled to an i−2-th scan line Si−2 and a first electrode of the fifth transistor M5 is electrically coupled to the first node N1. In addition, a second electrode of the fifth transistor M5 is electrically coupled to the anode electrode (i.e., third node N3) of the organic light emitting diode OLED. The fifth transistor M5 is turned on when the scan signal is supplied to the i−2-th scan line Si−2 to supply the voltage of the third node N3 to the first node N1.

A gate electrode of the sixth transistor M6 is electrically coupled to the i-th emission control line Ei and a first electrode of the sixth transistor M6 is electrically coupled to the second electrode of the first transistor M1. In addition, a second electrode of the sixth transistor M6 is electrically coupled to a third node N3. The sixth transistor M6 is turned off when the emission control signal is supplied to the i-th emission control line Ei and otherwise, the sixth transistor M6 is turned on. In other words, as described herein according to described embodiments, the emission control signal is referred to as being supplied when it has a high level (e.g., to turn off the transistor) and is referred to as not being supplied when it has a low level (e.g., to turn on the transistor).

The first capacitor C1 is electrically coupled between the first node N1 and the second node N2. The first capacitor C1 may be charged with a voltage corresponding to a threshold voltage of the first transistor M1.

The second capacitor C2 is electrically coupled between the second node N2 and the first power source ELVDD. The second capacitor C2 may be charged with a voltage corresponding to the data signal.

Figure 3:
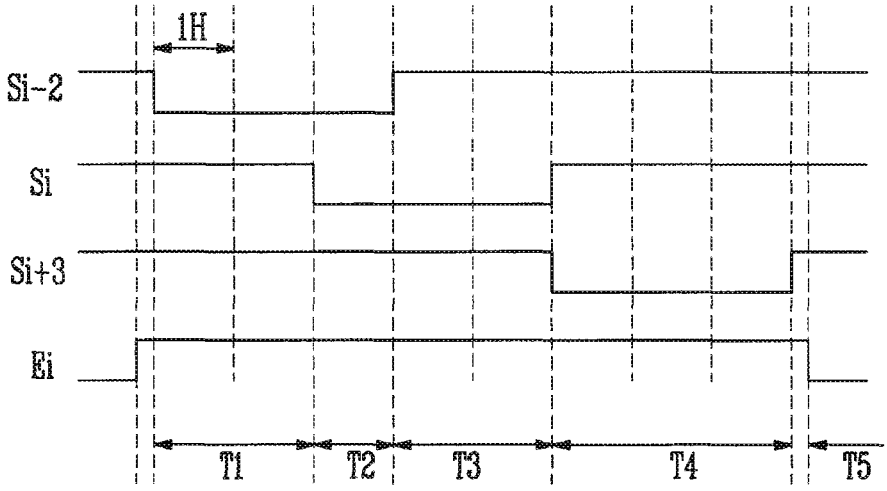
FIG. 3 is a waveform diagram illustrating a driving method of a first exemplary embodiment of the pixel shown in FIG. 2.

FIG. 3 is a waveform diagram illustrating a driving method according to a first exemplary embodiment of the present invention.

Referring to FIG. 3, first, during a first period T1 to a fourth period T4, the emission control signal is supplied to the emission control line Ei. When the emission control signal is supplied to the emission control line Ei, the sixth transistor M6 is turned off.

The scan signal is supplied to the i−2-th scan line Si−2 during the first period T1. When the scan signal is supplied to the i−2-th scan line Si−2, the fifth transistor M5 is turned on. When the fifth transistor M5 is turned on, the voltage of the third node N3 is supplied to the first node N1. Herein, the voltage of the third node N3 is set to a voltage acquired by adding the threshold voltage of the organic light emitting diode OLED to the voltage of the second power source ELVSS. The first period T1 is set as an initialization period for changing the voltage of the first node N1 to that of the third node N3.

The scan signal is supplied to the i-th scan line Si during the second period T2. When the scan signal is supplied to the i-th scan line Si, the second transistor M2 and the fourth transistor M4 are turned on. When the fourth transistor M4 is turned on, the voltage of the first power source ELVDD is supplied to the second node N2. When the second transistor M2 is turned on, the first node N1 electrically coupled to the second electrode of the second transistor M2 and the second electrode of the first transistor M1 are electrically coupled to each other. As a result, the first transistor M1 is diode-connected (or diode-coupled).

During the second period T2, the scan signal supplied to the i−2-th scan line Si−2 and the scan signal supplied to the i-th scan line Si are overlapped with each other during a period of 1H. In this case, periods in which the second transistor M2, the fourth transistor M4, and the fifth transistor M5 are turned on are overlapped with each other during the 1H period. As a result, it is possible to ensure driving reliability.

For example, when the second transistor M2 and the fourth transistor M4 are turned on after the fifth transistor M5 is turned off during high-speed driving, a nonuniform image may be partially displayed by a data signal of the previous frame. Accordingly, according to the exemplary embodiment of the present invention, the scan signal supplied to the i−2-th scan line Si−2 and the scan signal supplied to the i-th scan line Si are supplied to be overlapped with each other. As a result, it is possible to display an image of uniform luminance.

The scan signal ceases to be supplied to the i−2-th scan line Si−2 during the third period T3. When the scan signal ceases to be supplied to the i−2-th scan line Si−2, the fifth transistor M5 is turned off. When the fifth transistor M5 is turned off, the voltage of the first node N1 is set to a voltage value acquired by subtracting the threshold voltage of the first transistor M1 from that of the first power source ELVDD. At this time, the first capacitor C1 is charged with a voltage difference between the second node N2 and the first node N1, i.e., the voltage corresponding to the threshold voltage of the first transistor M1.

During a fourth period 14, the scan signal is supplied to the i+3 scan line Si+3. When the scan signal is supplied to the i+3-th scan line Si+3, the third transistor M3 is turned on. When the third transistor M3 is turned on, the data signal from the data line Dm is supplied to the second node N2. At this time, the second capacitor C2 is charged with a voltage corresponding to the data signal. During the fourth period T4, since the first node N1 is set at a floating state, the first capacitor C1 sustains the voltage which is charged during the third period T3.

Herein, since the third transistor M3 is turned on during a period having a duration of 3H, data signals corresponding to an i−2-th horizontal line, an i−1-th horizontal line, and the current horizontal line are sequentially supplied to the second node N2. In this case, the data signal corresponding to the current horizontal line is finally supplied to the second node N2, as a result, stable driving is possible.

During the fifth period T5, the emission control signal ceases to be supplied to the i-th emission control line Ei, and therefore, the sixth transistor M6 is turned on. When the sixth transistor M6 is turned on, the current corresponding to the voltage applied to the first node N1 is supplied from the first transistor M1 to the organic light emitting diode OLED. Meanwhile, the voltage applied to the first node N1 is set as the threshold voltage of the first transistor M1 and the voltage corresponding to the data signal. As a result, the current supplied from the first transistor M1 to the organic light emitting diode OLED is set regardless of the threshold voltage of the first transistor M1.

In the above-described embodiment of the present invention, the initialization periods T1 and T2 when the gate electrode of the first transistor M1 (e.g., the first node N1) is initialized is set as 3H and the period T3 when the threshold voltage is compensated is set as 2H. Therefore, according to the described embodiment of the present invention, even when the pixel is driven at a frequency of 120 Hz or more, the pixel can be stably driven while the threshold voltage of the driving transistor is sufficiently compensated. Meanwhile, in FIG. 3, the third period T3 is set as 2H, but the present invention is not limited thereto. Actually, according to embodiments of the present invention, it is possible to set the initialization period and the threshold voltage compensation period as long as a desired period while setting the width of the scan signal as 4H or more.

Figure 4:
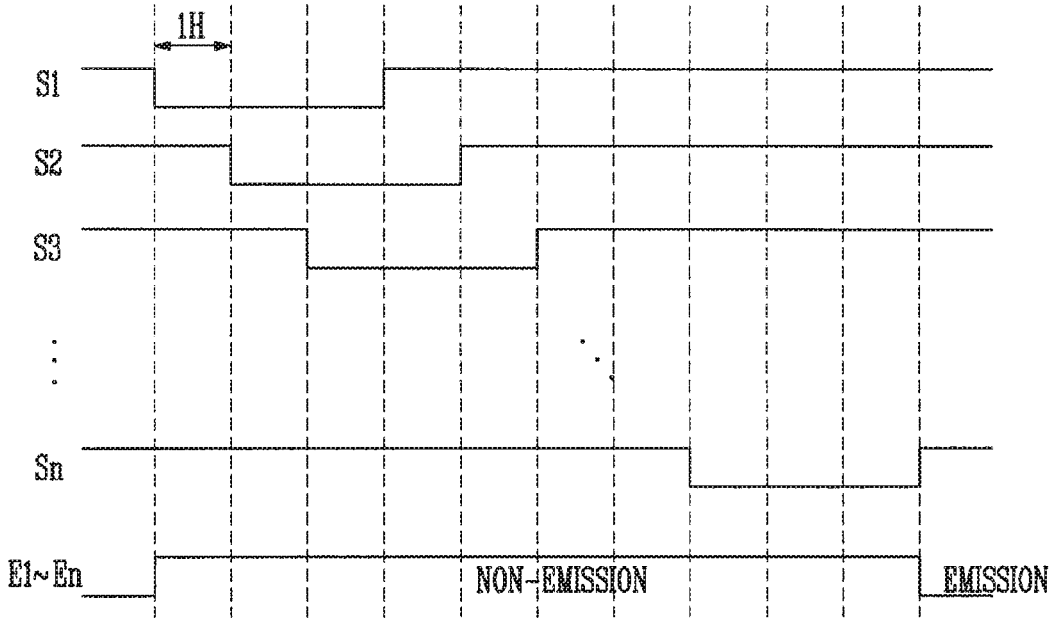
FIG. 4 is a waveform diagram illustrating a driving method of a second exemplary embodiment of the pixel shown in FIG. 2.

FIG. 4 is a waveform diagram illustrating a driving method according to a second exemplary embodiment of the present invention.

Referring to FIG. 4, the driving method according to the second exemplary embodiment of the present invention is substantially the same as the driving waveform shown in FIG. 3 in that the scan signal of 3H is supplied to the scan lines S1 to Sn, and the scan signal supplied to the i-th scan line Si is overlapped with the scan signal supplied to the i−1-th scan line Si−1 during the period having a duration of 2H.

However, the driving method according to the second exemplary embodiment of the present invention is different from the waveform of FIG. 2 in that the emission control signal is supplied to the emission control lines E1 to En. Specifically, in FIG. 4, the emission control signal is supplied to the emission control lines E1 to En during a period when the scan signal is supplied to the scan lines S1 to Sn, such that all the pixels 140 are set at a non-emission state. In addition, after the scan signal ceases to be supplied to the scan lines S1 to Sn, the emission control signal ceases to be supplied to the emission control lines E1 to En. When the emission control signals cease to be supplied to the emission control lines E1 to En, all of the pixels 140 are set at an emission state at substantially the same time (e.g., concurrently).

That is, in the driving waveform shown in FIG. 4, the emission and non-emission states of the pixels 140 are controlled concurrently (e.g., at substantially the same time); as a result, the pixels can be driven by various methods (i.e., 3D driving). Further, when the data signal is supplied while the pixels 140 are set at the non-emission state, the second capacitor C2 can be charged with a desired voltage regardless of a voltage drop of the first power source ELVDD.

Figure 5:
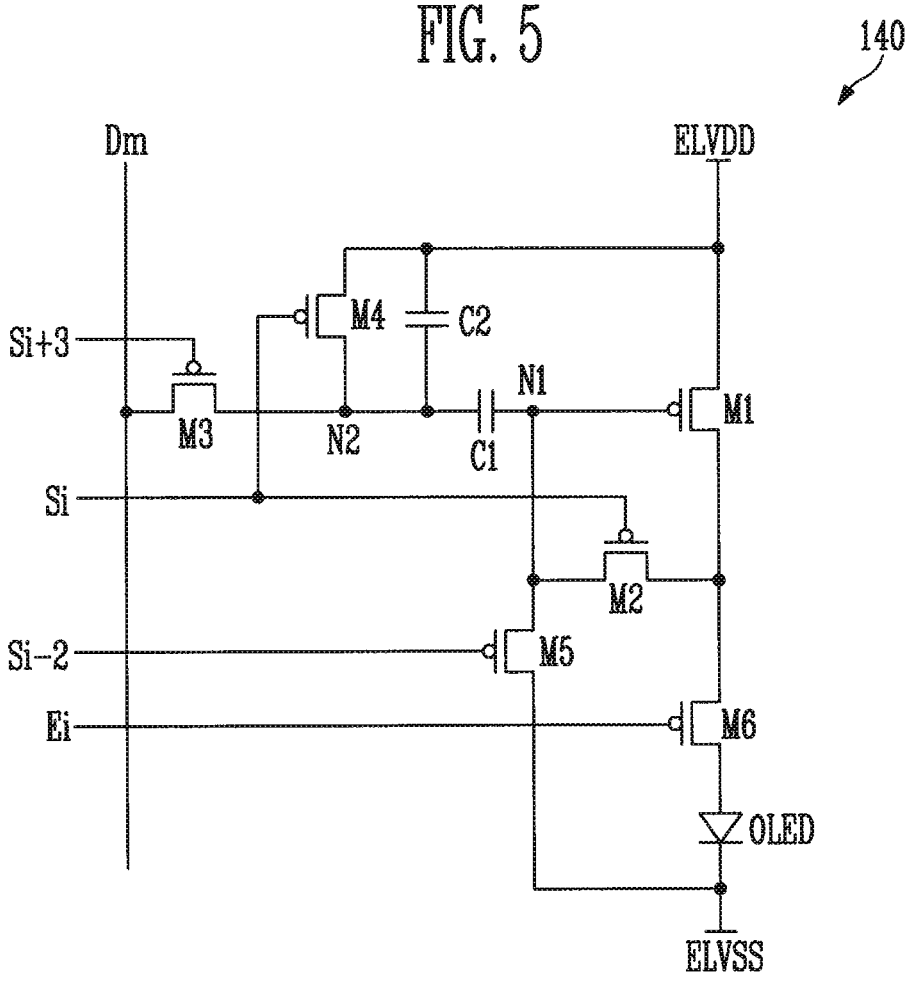
FIG. 5 is a circuit diagram illustrating a second exemplary embodiment of one of the pixels shown in FIG. 1.

FIG. 5 is a diagram showing a pixel according to a second exemplary embodiment of the present invention. When FIG. 5 is described, the same components as those of FIG. 2 refer to the same reference numerals and a detailed description thereof will be omitted.

Referring to FIG. 5, in the pixel 140 according to the second exemplary embodiment of the present invention, the second electrode of the fifth transistor M5 is electrically coupled to the second power source ELVSS. The fifth transistor M5 is turned on when the scan signal is supplied to the i−2-th scan line Si−2 to supply the voltage of the second power ELVSS to the first node N1. In other aspects, the driving method is substantially the same as that of FIG. 2. Therefore, a detailed description will be omitted.

Figure 6:
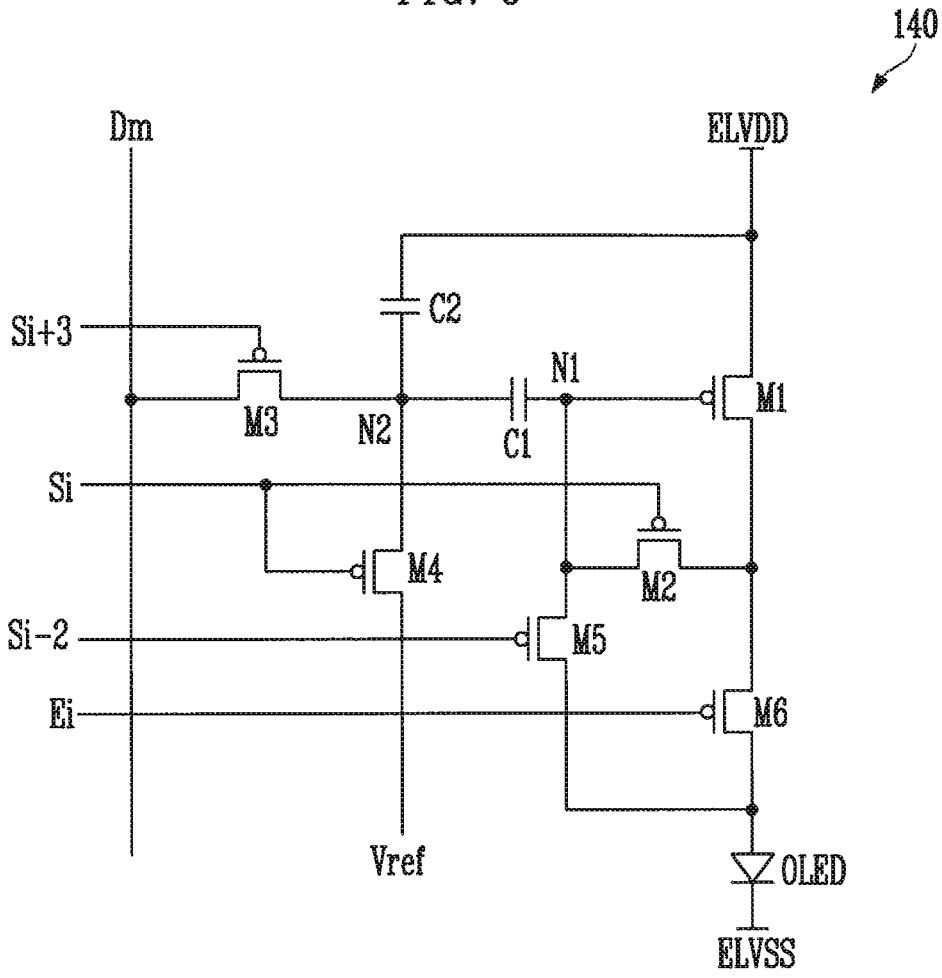
FIG. 6 is a circuit diagram illustrating a third exemplary embodiment of one of the pixels shown in FIG. 1.

FIG. 6 is a diagram illustrating a pixel according to a third exemplary embodiment of the present invention. When FIG. 6 is described, the same components as those of FIG. 2 refer to the same reference numerals and a detailed description thereof will be omitted.

Referring to FIG. 6, in the pixel 140 according to the third exemplary embodiment of the present invention, the second electrode of the fourth transistor M4 is electrically coupled to a reference power source Vref. The fourth transistor M4 is turned on when the scan signal is supplied to the i-th scan line Si to supply the voltage of the reference power source Vref to the second electrode N2. Herein, the reference power source Vref is set to have a DC voltage (e.g., a predetermined DC voltage), for example, voltage higher than that of the data signals.

Figure 7:
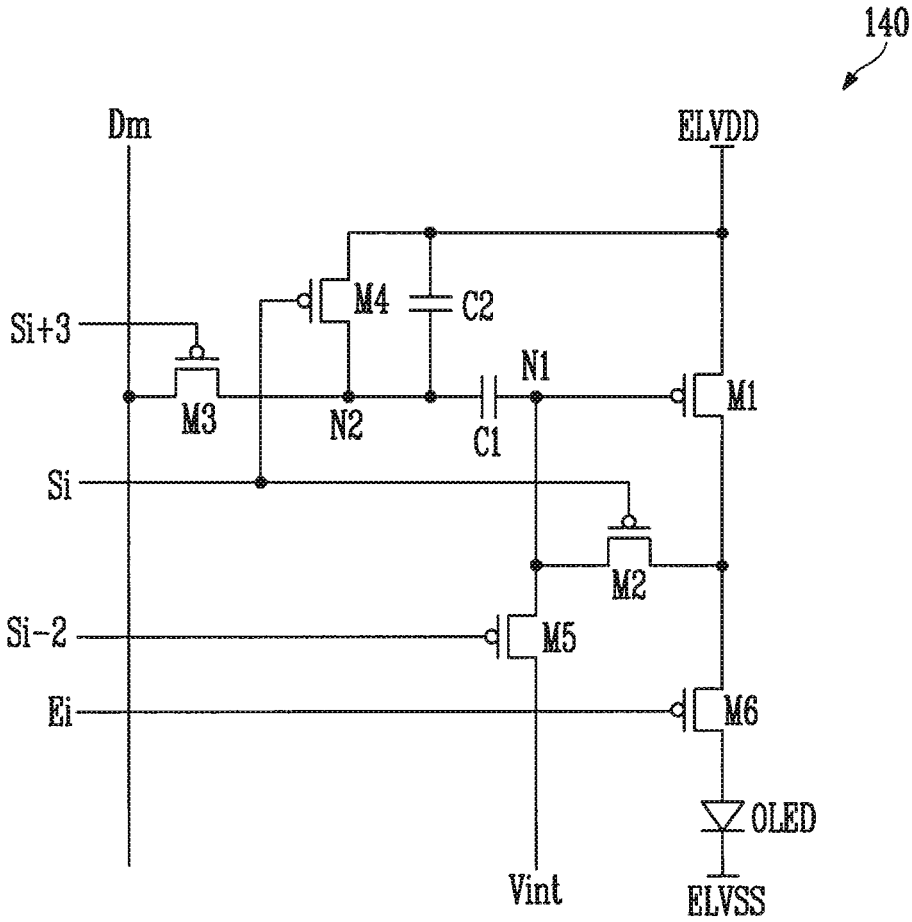
FIG. 7 is a circuit diagram illustrating a fourth exemplary embodiment of one of the pixels shown in FIG. 1.

FIG. 7 is a diagram illustrating a pixel according to a fourth exemplary embodiment of the present invention. When FIG. 7 is described, the same components as those of FIG. 2 refer to the same reference numerals and a detailed description thereof will be omitted.

Referring to FIG. 7, in the pixel 140 according to the fourth exemplary embodiment of the present invention, the second electrode of the fifth transistor M5 is electrically coupled to an initialization power source Vint. The fifth transistor M5 is turned on when the scan signal is supplied to the i−2-th scan line Si−2 to supply the voltage of the initialization power source Vint to the first node N1. Herein, the initialization voltage Vint is set as a DC voltage (e.g., a predetermined DC voltage), for example, a voltage lower than that of the data signals.

Figure 8:
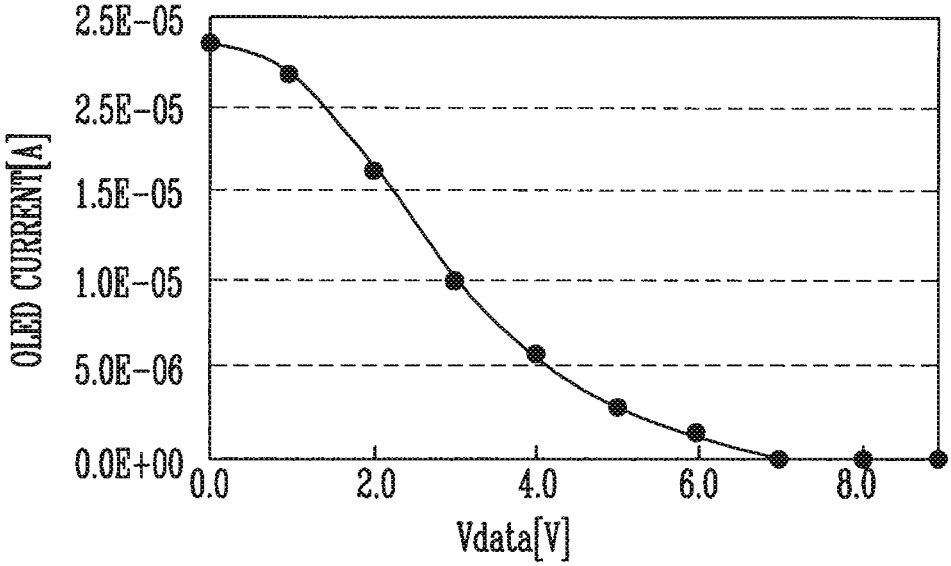
FIG. 8 is a graph illustrating a current amount corresponding to the voltage of a data signal of the pixel shown in FIG. 2.

FIG. 8 is a graph illustrating a current amount corresponding to the voltage of a data signal of a pixel shown in FIG. 2.

Referring to FIG. 8, in the pixel 140 according to embodiments of the present invention, when voltage of 0 to 8V is applied as the voltage of the data signals, the amount of current which flows to the organic light emitting diode OLED varies by approximately 25 μA. That is, in embodiments according to the present invention, a gray (or a gray level) can be displayed by applying the data signal of 0 to 8V; as a result, low-voltage driving is possible.

In the description of the pixels 140, the second capacitor C2 is electrically coupled between the second node N2 and the first power ELVDD, but the present invention is not limited thereto. For example, the second capacitor C2 may be electrically coupled between the first node N1 and the first power source ELVDD as shown in FIG. 9.

When an operation process is schematically described, when the third transistor M3 is turned on to supply the data signal to the second node N2, the voltage of the second node N2 varies. When the voltage of the second node N2 varies, the voltage of the first node N1 also varies through capacitive coupling of the first capacitor C1. At this time, the second capacitor C2 is charged with a voltage corresponding to a voltage difference between the first node N1 and the first power ELVDD. That is, in the pixel shown in FIG. 2, the second capacitor C2 is charged with the voltage corresponding to the voltage difference between the data signal and the first power ELVDD and in the pixel shown in FIG. 9, the second capacitor C2 is charged with the voltage corresponding to the voltage difference between the first node N1 and the first power source ELVDD. Herein, since the voltage of the first node N1 is controlled by the voltage of the data signal, the voltage charged in the second capacitor C2 is controlled by the data signal; as a result, the amount of current supplied to the organic light emitting diode OLED is determined by the data signal.

Figure 9:
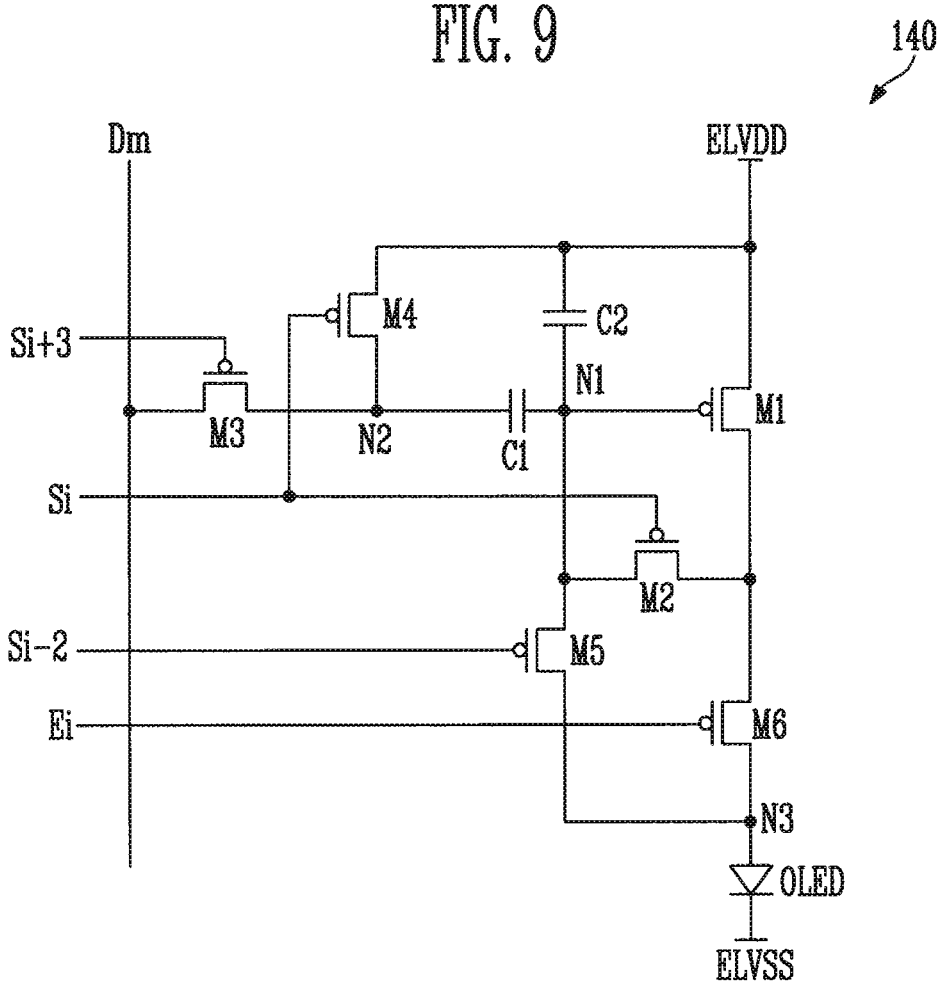
FIG. 9 is a circuit diagram illustrating a fifth exemplary embodiment of one of the pixels shown in FIG. 1.

Additionally, in FIG. 9, the position of the second capacitor C2 is changed in the pixel shown in FIG. 2 for better comprehension and ease of description, but the present invention is not limited thereto. That is, even in the pixels 140 shown in FIGS. 5 to 7, the second capacitor C2 may be positioned between the first node N1 and the first power ELVDD.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display device comprising:

a scan driver for sequentially supplying scan signals having a width of at least 2H (where "H" represents a horizontal period) to scan lines and for supplying emission control signals to emission control lines arranged in parallel to the scan lines, the scan signals partially overlapping with each other;

a data driver for supplying data signals to data lines; and pixels located at crossing regions of the scan lines and the data lines, wherein each of the pixels comprises:

an organic light emitting diode having a cathode electrode electrically coupled to a second power source;

a first transistor having a first electrode coupled to a first power source, and located between the first power source and the organic light emitting diode, the first transistor being for controlling an amount of current supplied from the first, power source to the organic light emitting diode;

a second transistor between a gate electrode and a second electrode of the first transistor and configured to be turned on in response to a corresponding one of the scan signals being supplied to a current scan line of the scan lines, the gate electrode of the first transistor being electrically coupled to a first node;

a third transistor between a corresponding one of the data lines and a second node and configured to be turned on when a corresponding one of the scan signals is supplied to a subsequent scan line of the scan lines;

a first capacitor electrically coupled between the gate electrode of the first transistor and the second node; and a fourth transistor coupled between the gate electrode of the first transistor and the organic light emitting diode, wherein a gate electrode of the fourth transistor is configured to receive a corresponding one of the scan signals supplied to a previous scan line of the scan lines to supply a first voltage to the gate electrode of the first transistor.

2. The organic light emitting display device of claim 1, further comprising:

a fifth transistor for supplying a second voltage to the second node when the corresponding one of the scan signals is supplied to the current scan line; and a sixth transistor between the second electrode of the first transistor and the organic light emitting diode and configured to be turned off when a corresponding emission control signal of the emission control signals is supplied to a current emission control line of the emission control lines.

3. The organic light emitting display device of claim 2, wherein the fifth transistor is between the second node and the first power source.

4. The organic light emitting display device of claim 2, wherein the fifth transistor is between the second node and a reference power source for supplying the second voltage, and the second voltage is equal to or greater than a voltage of the data signals.

5. The organic light emitting display device of claim 2, wherein the fourth transistor is between the gate electrode of the first transistor and the second power source.

6. The organic light emitting display device of claim 1, further comprising: a second capacitor electrically coupled between the second node and the first power source.

7. The organic light emitting display device of claim 1, further comprising: a second capacitor electrically coupled between the gate electrode of the first transistor and the first power source.

8. The organic light emitting display device of claim 1, wherein the scan driver is configured to supply the emission control signals to the emission control lines concurrently while the scan signals are sequentially supplied to all the scan lines and does not supply the emission control signals to the emission control lines after the scan signals cease to be supplied.

9. The organic light emitting display device of claim 1, wherein the data driver is configured to supply the data signals to the data lines every period of 1H.

10. An organic light emitting display device comprising:

a scan driver for sequentially supplying scan signals having a width of at least 2H (where "H" represents a horizontal period) to scan lines and for supplying emission control signals to emission control lines arranged in parallel to the scan lines, the scan signals partially overlapping with each other;

a data driver for supplying data signals to data lines; and pixels located at crossing regions of the scan lines and the data lines, wherein each of the pixels comprises:

an organic light emitting diode having a cathode electrode electrically coupled to a second power source;

a first transistor having a first electrode coupled to a first power source, and located between the first power source and the organic light emitting diode, the first transistor being for controlling an amount of current supplied from the first power source to the organic light emitting diode;

a second transistor between a gate electrode and a second electrode of the first transistor and configured to be turned on when a corresponding one of the scan signals is supplied to a current scan line of the scan lines, the gate electrode of the first transistor being electrically coupled to a first node;

a third transistor between a corresponding one of the data lines and a second node and configured to be turned on when a corresponding one of the scan signals is supplied to a subsequent scan line of the scan lines;

a first capacitor electrically coupled between the gate electrode of the first transistor and the second node;

a fourth transistor configured to be turned on when a corresponding one of the scan signals is supplied to a previous scan line of the scan lines to supply a first voltage to the gate electrode of the first transistor;

a fifth transistor for supplying a second voltage to the second node when the corresponding one of the scan signals is supplied to the current scan line; and a sixth transistor between the second electrode of the first transistor and the organic light emitting diode and configured to be turned off when a corresponding emission control signal of the emission control signals is supplied to a current emission control line of the emission control lines, wherein the current scan line is an i-th scan line of the scan lines, the previous scan line is an i−2-th scan line of the scan lines, and the subsequent scan line is an i+3-th scan line of the scan lines, wherein i is a natural number.

11. The organic light emitting display device of claim 10, wherein the fourth transistor is between the gate electrode of the first transistor and an initialization power source for supplying the first voltage, and the first voltage is lower than a voltage of the data signals.

12. The organic light emitting display device of claim 10, wherein the current emission control line is an i-th emission control line of the emission control lines.

13. The organic light emitting display device of claim 10, wherein the scan driver is configured to supply the scan signals during a period of 3H and the scan signal supplied to the i-th scan line from among the scan signals is overlapped with the scan signal supplied to an i−1-th scan line from among the scan signals during a period of 2H.

14. The organic light emitting display device of claim 13, wherein the scan driver is configured to sequentially supply the emission control signals to the emission control lines, and the emission control signal supplied to an i-th emission control line from among the emission control signals is overlapped with the scan signals supplied to the i−2-th scan line through the i+3-th scan line.

15. A pixel comprising:

an organic light emitting diode having a cathode electrode electrically coupled to a second power source;

a first transistor having a first electrode coupled to a first power source, and configured to control an amount of current from the first power source to the organic light emitting diode;

a second transistor between a gate electrode and a second electrode of the first transistor and configured to be turned on when a scan signal is supplied to an i-th scan line, wherein the gate electrode of the first transistor is electrically coupled to a first node and i is a natural number;

a third transistor between a data line and a second node and configured to be turned on when the scan signal is supplied to an i+3-th scan line;

a first capacitor electrically coupled between the gate electrode of the first transistor and the second node;

a fourth transistor for supplying a second voltage to the second node when the scan signal is supplied to the i-th scan line; and a fifth transistor configured to be turned on when the scan signal is supplied to an i−2-th scan line to supply a first voltage to the gate electrode of the first transistor.

16. The pixel of claim 15, further comprising:

a second capacitor electrically coupled between the second node and the first power source.

17. The pixel of claim 15, further comprising:

a second capacitor electrically coupled between the gate electrode of the first transistor and the first power source.

18. The pixel of claim 15, further comprising:

a sixth transistor between the second electrode of the first transistor and the organic light emitting diode and configured to be turned off when an emission control signal is supplied to an i-th emission control line.

19. The pixel of claim 15, wherein the fourth transistor is between the second node and the first power source.

20. The pixel of claim 15, wherein the fourth transistor is between the second node and a reference power source for supplying the second voltage, and the second voltage is equal to or greater than a voltage of a data signal supplied to the data line.

21. The pixel of claim 15, wherein the fifth transistor is electrically coupled to the gate electrode of the first transistor and an anode electrode of the organic light emitting diode.

22. The pixel of claim 15, wherein the fifth transistor is between the gate electrode of the first transistor and the second power source.

23. The pixel of claim 15, wherein the fifth transistor is between the gate electrode of the first transistor and an initialization power source for supplying the first voltage, and the first voltage is lower than a voltage of a data signal supplied to the data line.

24. The pixel of claim 15, wherein a turn-on period of the first transistor is partially overlapped with a turn-on period of the second transistor.

* * * * *